US008616194B2

(12) United States Patent
Sherrow et al.

(10) Patent No.: US 8,616,194 B2
(45) Date of Patent: Dec. 31, 2013

(54) GAS-FIRED FURNACE AND INTAKE MANIFOLD FOR LOW $NO_x$ APPLICATIONS

(75) Inventors: Lester D. Sherrow, Whitehouse, TX (US); Scott A. Lackie, Granger, IN (US)

(73) Assignee: Trane International Inc., Piscataway, NJ (US)

( * ) Notice: Subject to any disclaimer, the term of this patent is extended or adjusted under 35 U.S.C. 154(b) by 182 days.

(21) Appl. No.: 13/077,518

(22) Filed: Mar. 31, 2011
(Under 37 CFR 1.47)

(65) Prior Publication Data

US 2012/0247444 A1 Oct. 4, 2012

(51) Int. Cl.
*F24H 3/06* (2006.01)

(52) U.S. Cl.
USPC ..... 126/116 R; 126/110 A; 126/110 C; 431/12; 431/354; 239/557; 165/104.34

(58) Field of Classification Search
USPC ..... 126/116 R, 110 A, 110 C; 431/12, 354, 7, 431/278; 239/557; 165/104.34, 145
See application file for complete search history.

(56) References Cited

U.S. PATENT DOCUMENTS

| | | | | |
|---|---|---|---|---|
| 1,886,387 | A | | 11/1932 | Gallaher |
| 2,431,753 | A | | 12/1947 | Holderle et al. |
| 2,609,280 | A | * | 9/1952 | Cremean ..... 48/189.4 |
| 2,633,836 | A | * | 4/1953 | Cox ..... 123/523 |
| 2,682,867 | A | | 7/1954 | Cartter |
| 3,800,752 | A | | 4/1974 | Bruderlin |
| D405,095 | S | | 2/1999 | Wada |
| 5,899,686 | A | | 5/1999 | Carbone et al. |
| 6,018,946 | A | | 2/2000 | Matsumoto |
| 6,860,249 | B2 | | 3/2005 | Carpenter |
| 7,124,727 | B2 | | 10/2006 | Kogawa et al. |
| 7,497,079 | B2 | | 3/2009 | Yoshida et al. |

* cited by examiner

*Primary Examiner* — Alfred Basichas
(74) *Attorney, Agent, or Firm* — Conley Rose, P.C.; J. Robert Brown, Jr.; Alan Dawson Lightfoot

(57) ABSTRACT

A gas-fired air conditioning furnace comprises a monolithic intake manifold including an inlet at a first end and a plurality of outlets at a second end opposite the first end. In addition, the furnace comprises a burner assembly including a plurality of burners, each burner is configured to combust an air-fuel mixture at least partially within an interior space of the burner. Further, each burner extends into one of the outlets of the intake manifold.

19 Claims, 14 Drawing Sheets

GAS-FIRED FURNACE AND INTAKE MANIFOLD FOR LOW $NO_x$ APPLICATIONS

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

The invention relates generally to gas-fired indoor and outdoor furnaces. More particularly, the invention relates to intake manifolds for premix gas-fired furnaces. Natural gas and propane fired furnaces are widely used in commercial and residential environments for heating, including space heating for air conditioning interior spaces. Gas and propane fired furnaces are known to generate and emit oxides of nitrogen (NOx). In general, NOx refers to a group of highly reactive gases that contain nitrogen and oxide in various amounts (e.g., NO, $N_2O$, $NO_2$).

SUMMARY OF THE DISCLOSURE

These and other needs in the art are addressed in one embodiment by a gas-fired air conditioning furnace. In an embodiment, the furnace comprises a monolithic intake manifold including an inlet at a first end and a plurality of outlets at a second end opposite the first end. In addition, the furnace comprises a burner assembly including a plurality of burners, each burner is configured to combust an air-fuel mixture at least partially within an interior space of the burner. Further, each burner extends into one of the outlets of the intake manifold.

These and other needs in the art are addressed in another embodiment by an intake manifold for a gas-fired device. In an embodiment, the intake manifold comprises a monolithic body having a first end and a second end opposite the first end. In addition, the intake manifold comprises an inlet at the first end of the body. Further, the intake manifold comprises a plurality of outlets at the second end of the body. The body includes a distributor section including the inlet and a plurality of supply tubes extending from the distributor section. Each supply tube includes one of the plurality of outlets. The distributor is configured to receive an air-fuel mixture through the inlet and divide the air-fuel mixture among the plurality of supply tubes.

These and other needs in the art are addressed in another embodiment by a method of operating a gas-fired furnace. In an embodiment, the method comprises (a) supplying an air-fuel mixture to a single-piece intake manifold. The intake manifold has an inlet at a first end and a plurality of outlets at a second end opposite the first end. The intake manifold also includes a distributor extending from the first end and a plurality of supply tubes extending from the second end to the distributor. In addition, the method comprises (b) flowing the air-fuel mixture through the inlet of the intake manifold into the distributor. Further, the method comprises (c) dividing the air-fuel mixture in the distributor into a plurality of portions. Still further, the method comprises (d) flowing each portion of the air-fuel mixture through one of the supply tubes to a burner extending into the supply tube, one burner extends into each supply tube. Moreover, the method comprises (e) combusting the portion of the air-fuel mixture within each burner to form a hot flue gas.

Thus, embodiments described herein comprise a combination of features and advantages intended to address various shortcomings associated with certain prior devices, systems, and methods. The various characteristics described above, as well as other features, will be readily apparent to those skilled in the art upon reading the following detailed description, and by referring to the accompanying drawings.

BRIEF DESCRIPTION OF THE DRAWINGS

For a detailed description of the preferred embodiments of the invention, reference will now be made to the accompanying drawings in which.

DETAILED DESCRIPTION

In some cases, NOx emissions from furnaces may contribute to less than optimal air-fuel mixtures and combustion temperatures, and may generally be considered pollutants. Consequently, air pollution regulatory agencies, such as South Coast Air Quality Management District (SCAQMD), may limit the emission of NOx from furnaces. Some regulations may limit NOx emissions from gas-fired furnaces to less than 40 nano-grams per Joule (ng/J) of energy used. However, some stricter regulations that may become effective in 2012 may limit NOx emissions from gas-fired furnaces to less than 14 ng/J of energy used.

Some conventional natural gas and propane fired furnaces include a burner assembly having a plurality of discrete parts coupled together. For example, burner assemblies often includes a gas valve, a gas manifold pipe with fixed orifices, atmospheric type burners (i.e., unenclosed or open burners), and a burner holder or box. Air may be sucked through the pipe and gas may be injected at the burners. Such natural gas and propane furnaces may emit NOx at a much higher level, around 40 Ng/J, than a premix burner system in which the air and gas are mixed upstream of the burner assembly.

In some cases, an approach to obtain the lower NOx emissions from a gas-fired furnace is to employ premix burners, in which the air and fuel are mixed upstream of the burner. Some premix burners need to be sealed so as to not allow air leakage downstream of the air and fuel inlets. Although gaskets may be utilized in the connections between the different parts employed in gas-fired furnace employing premix burners, undesirable air leakage between the connections may occur. Such air leakage may undesirably alter the air-fuel ratio, increase NOx emissions, reduce furnace capacity, and/or increase the likelihood for flashbacks.

Accordingly, there may be a need to provide furnaces that generate a substantially reduced quantity of NOx by providing gas-fired furnaces and premix burner intakes that reduce the potential for ingress of air downstream of the air-fuel mixing device. Such furnaces and intakes may be particularly well received if they provided cost advantages and reduced NOx emissions. As such, the present disclosure, in some embodiments, provides a gas-fired furnace with reduced ingress of air into a pre-mixed air/fuel mixture along an intake assembly to lower NOx emissions. In some embodiments, a furnace is provided that emits NOx at lower than 14 nanograms per joule (ng/J) of energy used. In some embodiments, a furnace comprising a single-piece or monolithic intake manifold that eliminates connections typically in conventional furnace intake assemblies is provided to accomplish the above-described reductions in NOx emissions.

Figure 1:
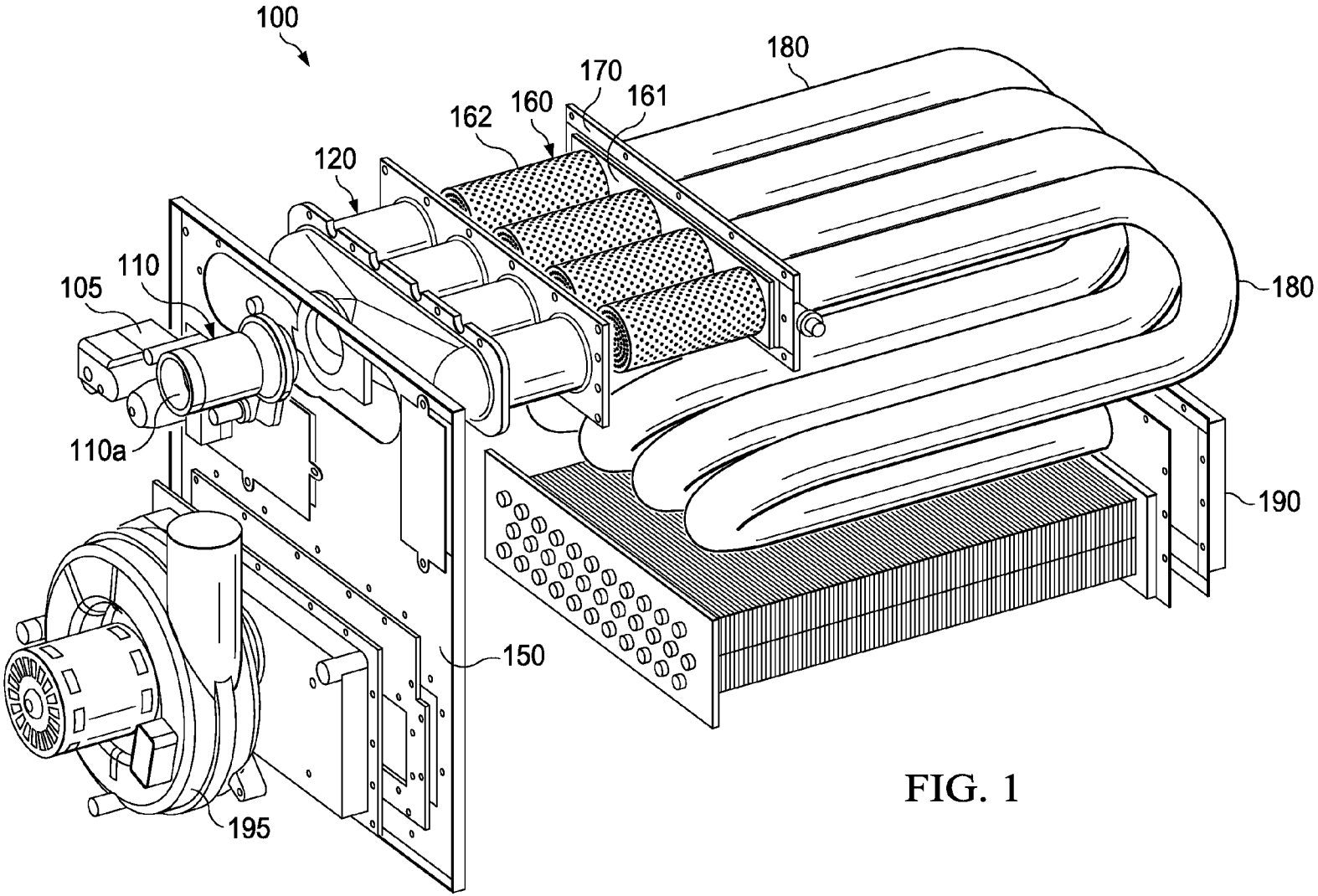
FIG. 1 is a perspective exploded view of an embodiment of a gas-fired furnace according to the principles described herein.
Figure 2:
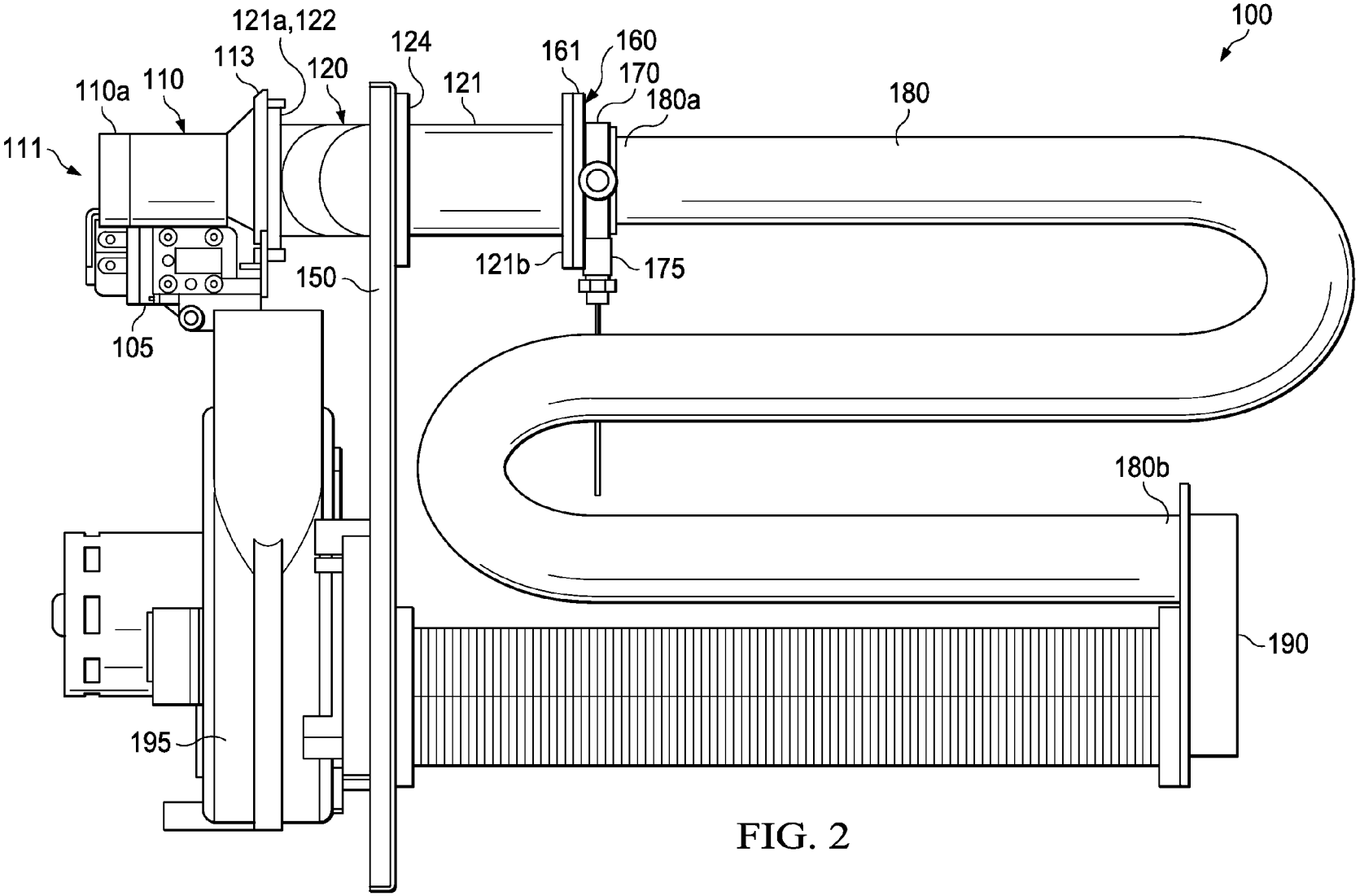
FIG. 2 is a side view of the gas-fired furnace of FIG. 1.
Figure 3:
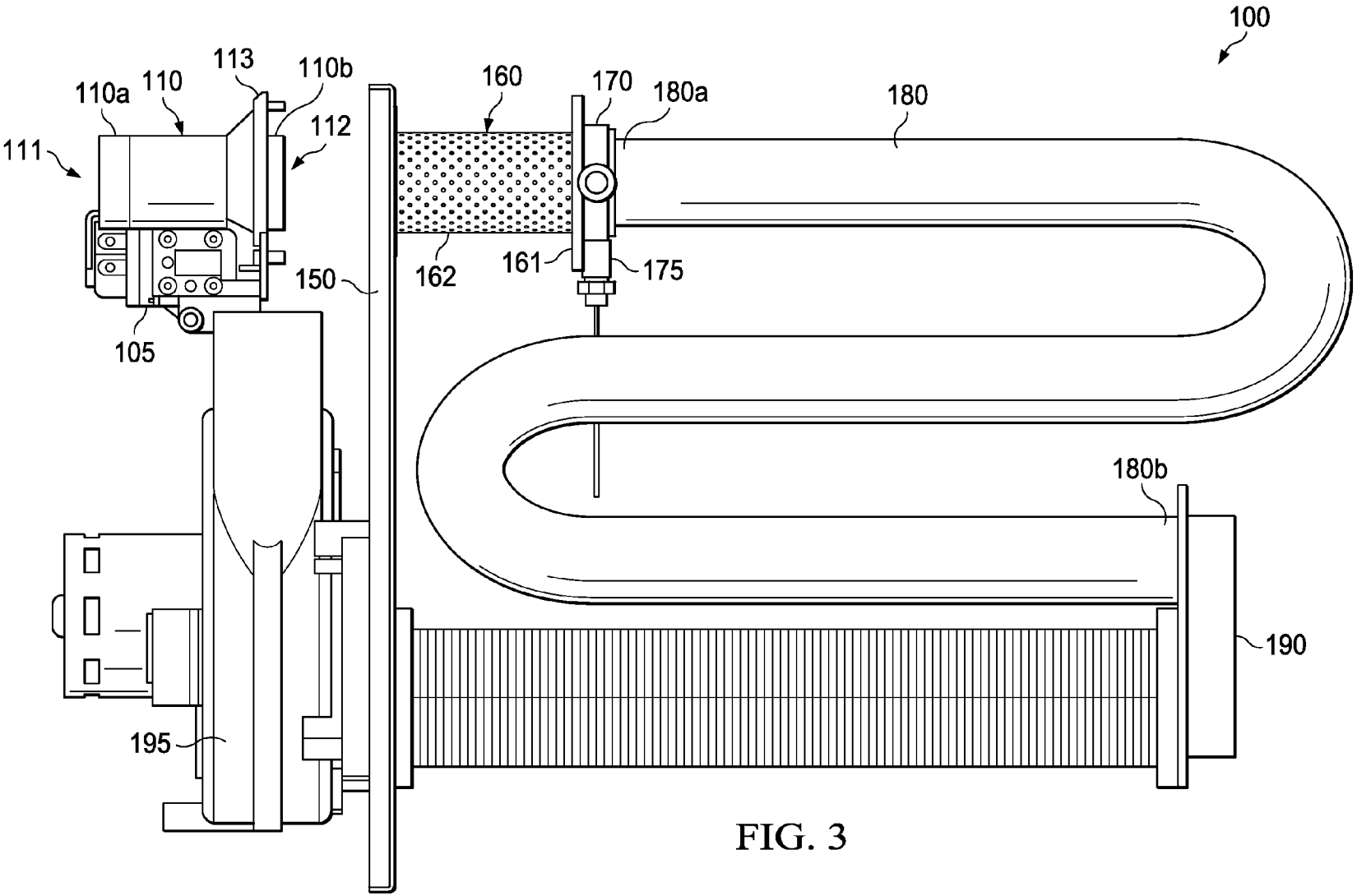
FIG. 3 is a side view of the gas-fired furnace of FIG. 1 with the intake manifold removed.
Figure 4:
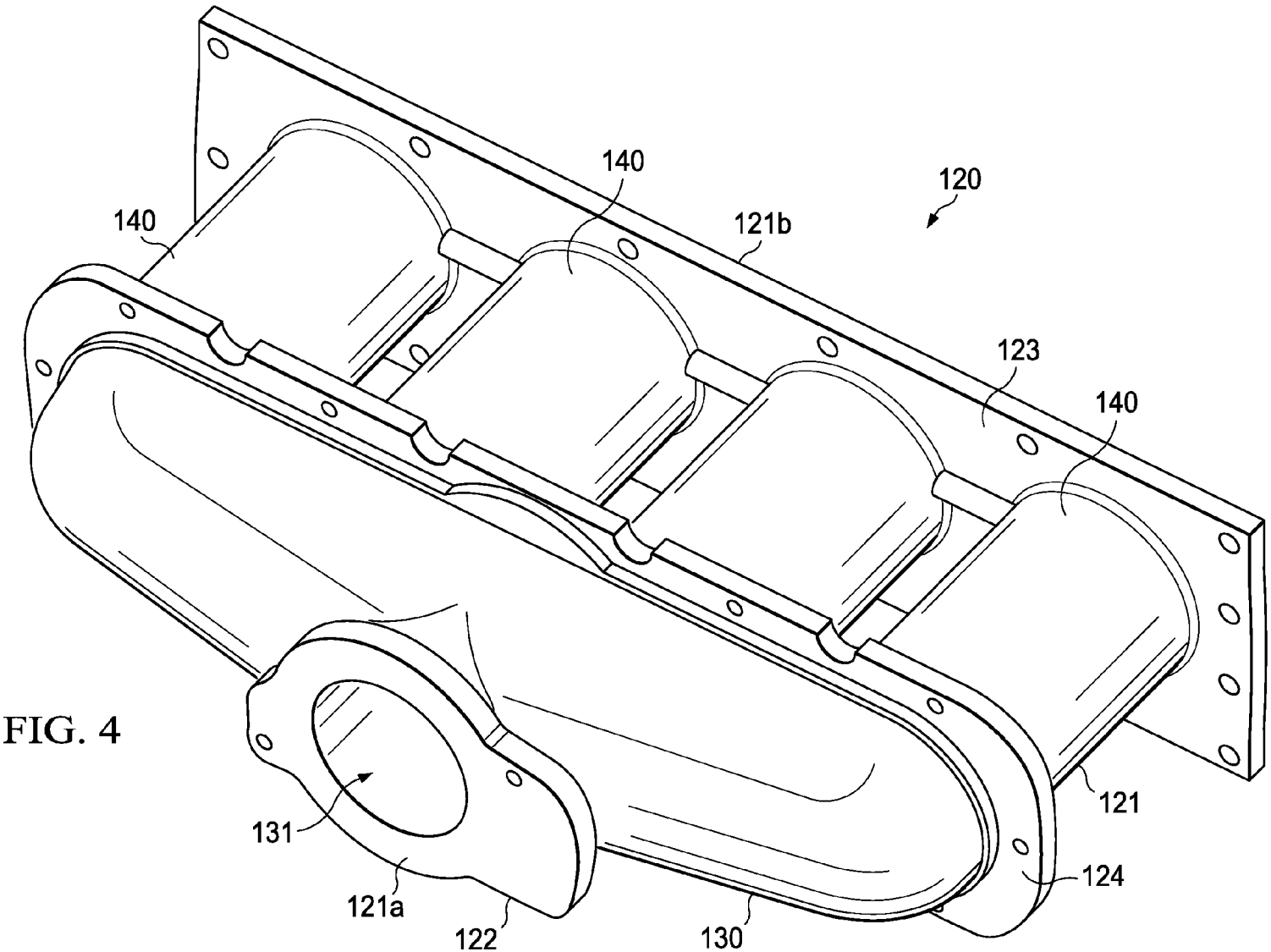
FIG. 4 is a perspective view of the intake manifold of FIG. 1.

Referring now to FIGS. 1-3, an embodiment of a gas-fired furnace 100 in accordance with the principles described herein is shown. In this embodiment, furnace 100 is configured as an indoor furnace that provides conditioned air (i.e., heated air) to an interior space. However, in general, the components of furnace 100 may be equally employed in an outdoor or weatherized furnace to condition an interior space. Moreover, furnace 100 may be used in residential or commercial applications.

In this embodiment, furnace 100 includes a gas supply valve 105, an air/fuel mixing tube 110, an intake manifold 120, a partition panel 150, a burner assembly 160, a post combustion chamber 170, a plurality of heat exchangers 180, and a heat exchanger exhaust chamber 190. As best shown in FIGS. 2 and 3, mixing tube 110 is coupled end-to-end with intake manifold 120, burner assembly 160 is positioned between intake manifold 120 and post combustion chamber 170, and heat exchangers 180 extend from post combustion chamber 170 to exhaust chamber 190. In addition, intake manifold 120 is secured to and extends through partition panel 150, which aids in mounting and orienting several components of furnace 100. Although a finned condensing heat exchanger is shown extending from exhaust chamber 190 below heat exchangers 180, in general, furnace 100 may be operated with or without a condensing heat exchanger as a "condensing" or "non-condensing" furnace, respectively.

Mixing tube 110 has an open upstream end 110*a* defining an air inlet 111, and an open downstream end 110*b* defining an air/fuel mixture outlet 112. An annular connection flange 113 extends radially outward from mixing tube 110 proximal downstream end 110*b*. Connection flange 113 couples mixing tube 110 to intake manifold 120. Fuel and air are introduced to the air/fuel mixing tube 110 to allow mixing before combustion, and thus, furnace 100 may be described as a "pre-mix" furnace. Fuel is introduced to the air/fuel mixing tube 110 by gas supply valve 105 mounted thereto, and air is introduced to mixing tube 110 via air inlet 111. Gas supply valve 105 may be adjusted either electrically or pneumatically to obtain the correct air to fuel ratio for increased efficiency and lower NOx emissions. In addition, gas supply valve 105 may be configured for either staged operation, or modulation type operation. For example, staged operation may have two flame settings, where modulation type operation may be incrementally adjustable over a large range of outputs, for example from 40% to 100% output capacity. In general, gas-fired furnace 100 may be operated with any suitable gaseous fuel including, without limitation, natural gas or propane.

Within mixing tube 110, the air and fuel are mixed together to form an air/fuel mixture that is preferably a uniform or homogenous mixture. Accordingly, in this embodiment, mixing tube 110 may include internal features downstream of air and fuel inlets that aid in the mixing of air and fuel within tube 110 by increasing downstream turbulence within the air/fuel mixture. The mixing of the air and fuel may also be aided by an active mixing device to encourage homogeneous mixing of the fuel and combustion air in the air/fuel mixing tube 110. The air/fuel mixture flows through outlet 112 of mixing tube 110 into intake manifold 120.

Figure 5:
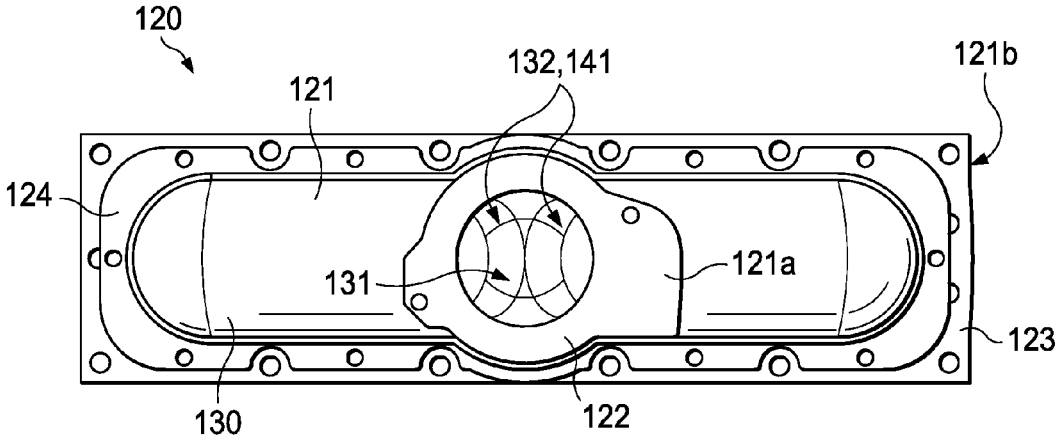
FIG. 5 is an inlet end view of the intake manifold of FIG. 1.
Figure 6:
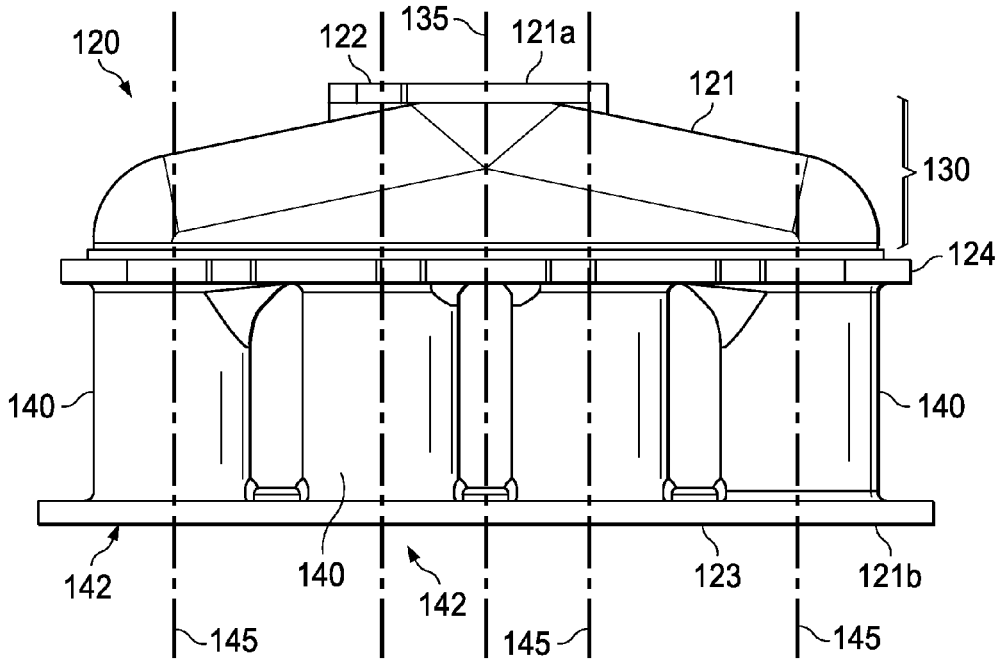
FIG. 6 is a top view of the intake manifold of FIG. 1.
Figure 7:
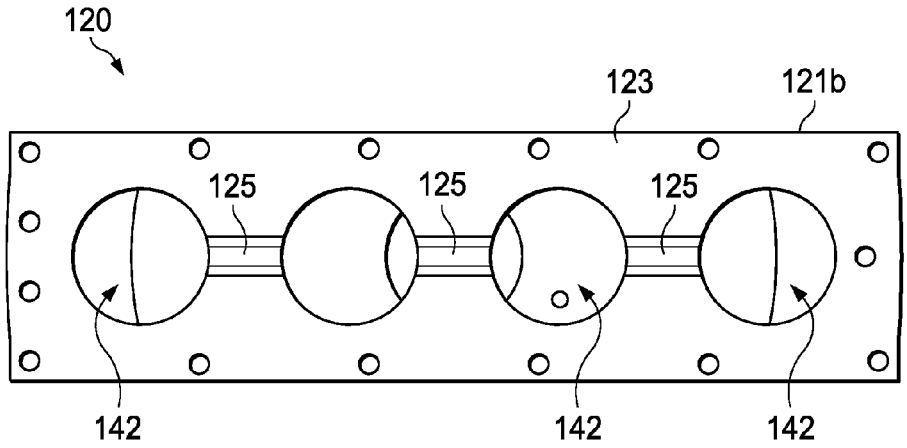
FIG. 7 is an outlet end view of the intake manifold of FIG. 1.

Referring now to FIGS. 4-7, in this embodiment, intake manifold 120 comprises a single-piece or monolithic body 121 having an upstream or inlet end 121*a*, a downstream or outlet end 121*b*, a flow distributor 130 extending from inlet end 121*a*, and a plurality of heat exchanger supply tubes 140 extending from distributor 130 to outlet end 121*b*. In addition, body 121 includes an inlet connection flange 122 at end 121*a* for coupling manifold 120 to mixing tube 110, an outlet connection flange 123 at end 121*a* for coupling manifold 120 to burner assembly 160 and post combustion chamber 170, and an intermediate connection flange 124 between ends 121*a*, b for coupling manifold 120 to partition panel 150 as shown in FIG. 2. In this embodiment, intermediate connection flange 124 is positioned at the intersection of distributor 130 and heat exchanger supply tubes 140. As best shown in FIG. 7, outlet connection flange 123 includes a recess 125 extending between each pair of adjacent heat exchanger supply tubes 140 at end 121*b*.

The air/fuel mixture from mixing tube 110 flows through distributor 130 to each heat exchange supply tube 140. Specifically, distributor 130 receives the air/fuel mixture via an air/fuel inlet 131 at end 121*a*, and distributes the air/fuel mixture among the plurality of heat exchange supply tubes 140 via a plurality of air/fuel outlets 132 at the intersection of distributor 130 and supply tubes 140; each outlet 132 being in fluid communication with one of the heat exchanger supply tubes 140. In this embodiment, distributor 130 is configured to evenly distribute the air/fuel mixture among the heat exchanger supply tubes 140. In other words, each heat exchanger supply tube 140 receives substantially the same volumetric flow rate of the air/fuel mixture from distributor 130.

Referring still to FIGS. 4-7, supply tubes 140 deliver the air/fuel mixture to burner assembly 160 for combustion. In this embodiment, each supply tube 140 is a tubular having an inlet 141 in fluid communication with one air/fuel outlet 132, and an outlet 142 at end 121*b*. As best shown in FIGS. 5 and 6, the transition between each air/fuel outlet 132 and corresponding supply tube inlet 141 on the inner surface of body 121 are radiused to streamline flow of the air/fuel mixture from distributor 130 into supply tubes 140, and to enhance uniform distribution of the air/fuel mixture among the plurality of supply tubes 140.

As previously described, the air/fuel mixture enters intake manifold 120 through inlet 131 of distributor 130, and exits intake manifold 120 through outlets 142 of supply tubes 140. Accordingly, inlet 131 functions as the inlet of distributor 130 and intake manifold 120, and outlets 142 function as the outlet of supply tubes 140 and intake manifold 120.

Referring briefly to FIGS. 2, 6, and 7, intake manifold 120, distributor 130, and inlet 131 share a common central axis 135, and each heat exchanger supply tube 140 and its corresponding outlet 142 shares a common central axis 145 that is parallel to axis 135. In this embodiment, each axis 135, 145 is disposed in the same plane, and further, as oriented in furnace 100, the plane containing each axis 135, 145 is horizontal.

In general, intake manifold 120 may comprise any suitable material(s), but preferably comprises durable materials suitable for high temperature furnace applications. In addition, as previously described, body 121 of intake manifold 120 is monolithically formed. Thus, intake manifold 120 preferably comprises a material that may be cast, machined, or otherwise formed as a single-piece such as steel or aluminum.

Figure 8:
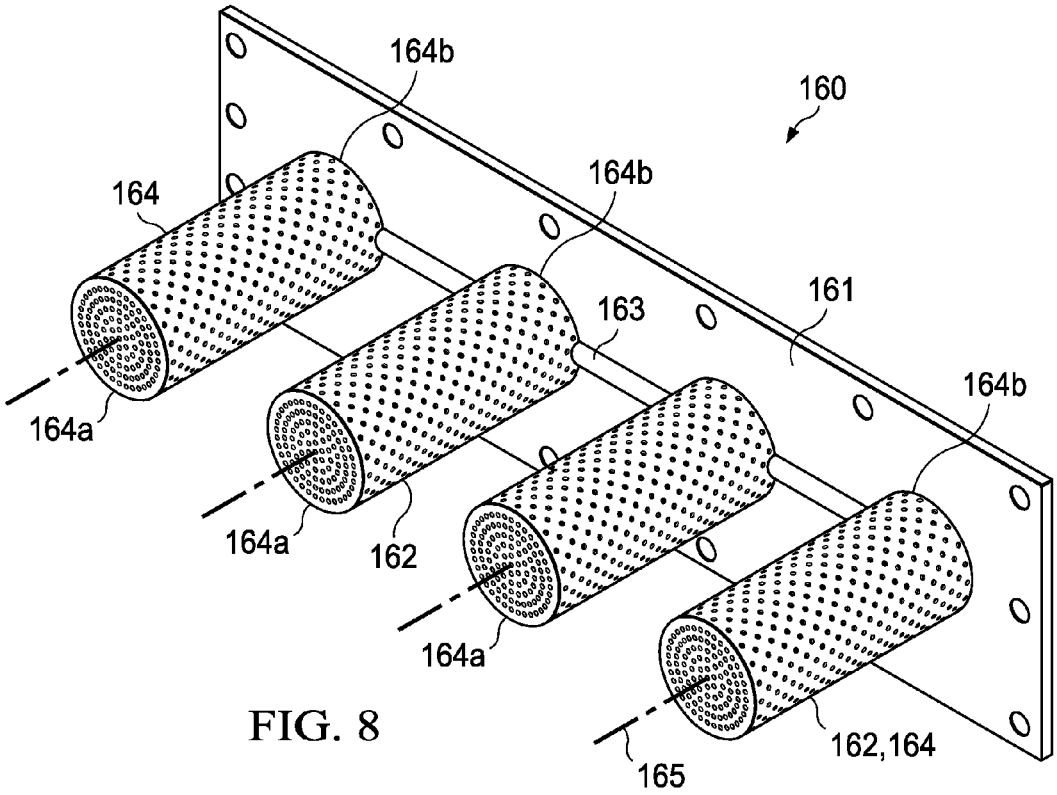
FIG. 8 is a perspective view of the burner assembly of FIG. 1.
Figure 9:
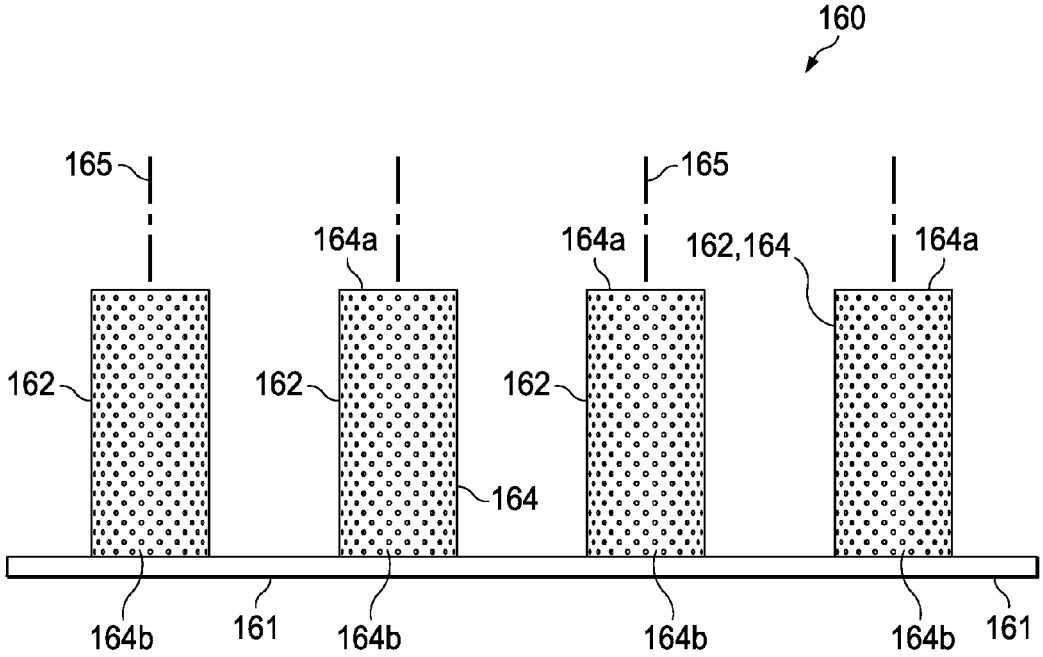
FIG. 9 is a side view of the burner assembly of FIG. 1.
Figure 10:
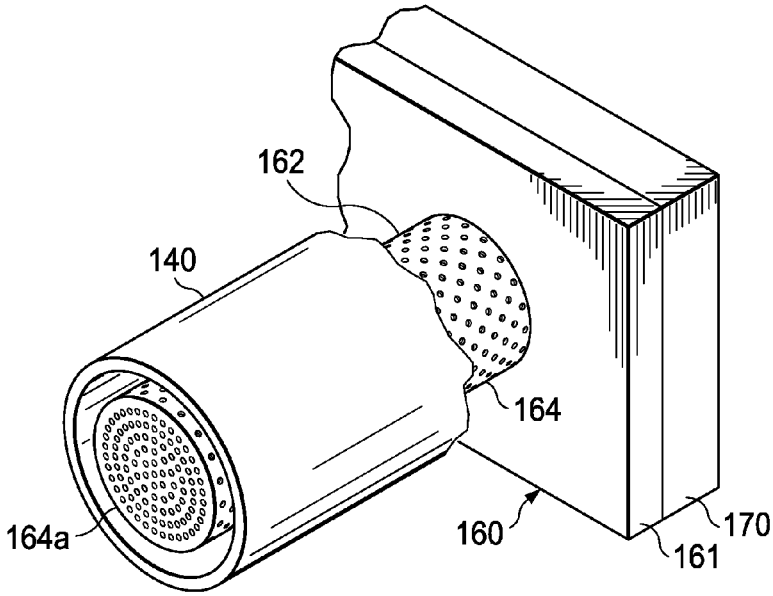
FIG. 10 is a partial cut-away perspective view of one of the burners of FIG. 8 received within one of the supply tubes of FIG. 4.

Referring now to FIGS. 1-3 and 8-10, burner assembly 160 includes a mounting flange 161 and a plurality of cylindrical burners 162 extending perpendicularly therefrom. As shown in FIGS. 1 and 2, flange 161 is sandwiched between connection flange 123 of intake manifold 120 and post combustion chamber 170. Flange 161 includes a recess 163 that extends between each pair of adjacent burners 162. Recess 163 is opposed recess 125 of flange 123 of intake manifold 120, and together, recesses 125, 163 define a flame carry over path. As best shown in FIG. 10, burners 162 extend axially into supply tubes 140—one burner 162 is coaxially disposed within each supply tube 140. Each supply tube 140 is sized to have an inner diameter slightly larger than the outer diameter of its corresponding burner 162.

Referring now to FIGS. 8 and 9, each burner 162 comprises a cylindrical tubular 164 having a central axis 165, an occluded upstream end 164*a* disposed in a corresponding supply tube 140, and an open downstream end 164*b* connected to flange 161. Each open end 164*b* is in fluid communication with heat exchangers 180 via post combustion chamber 170. In this embodiment, burners 162 are perforated to allow the air/fuel mixture in supply tubes 140 to flow into the interior of each burner 162 for combustion therein. In particular, a plurality of small holes or perforations are provided in end 164*a* and cylindrical tubular 164, thereby allowing the air/fuel mixture to flow axially through end 164*a* into burners 162 and radially inward through cylindrical tubular 164 into burners 162. In general, burners 162 may comprise any suitable type of perforated premix cylindrical burner such as the cylindrical metal premix burners sold by Worgas of Formigine, Italy.

By positioning burners 162 within the heat exchanger supply tubes 140, burners 162 are positioned within a combustion airflow path, therefore substantially all of the combustion air passes through burners 162. In this embodiment, each burner 162 has an associated heat exchanger 180 for venting hot flue gases such that the heat exchanger 180 is in the combustion airflow path of its associated burner 162. While four supply tubes 140 and four corresponding burners 162 are provided in this embodiment, in general, the total number of supply tubes (e.g., supply tubes 140) and burners (e.g., burners 162) may vary depending upon the desired capacity of the furnace (e.g., furnace 100).

Referring again to FIGS. 1-3, an igniter 175 mounted to post combustion chamber 170 has an ignition tip positioned at open end 164*b* of one of outer burners 162 (i.e., burner 162 visible in FIG. 3) to ignite the air/fuel mixture in that particular burner 162. The remaining burners 162 are subsequently ignited via the flame carry over path defined by recesses 125, 163 extending between each pair of adjacent burners 162. In general, igniter 175 may comprise any suitable device for inducing combustion of the air/fuel mixture within burners 162 including, without limitation, a pilot light, a piezoelectric device, or a hot surface igniter. Igniter 175 may be controlled by a control system or may be manually ignited. In addition, a flame sensor (not shown) is mounted to intake manifold 120 proximal the outer burner 162 furthest from igniter 175. In other words, igniter 175 and the flame sensor are positioned on opposite sides of intake manifold 120. The flame sensor detects when the flame front extends across each of burners 162. The flame sensor may comprise a thermocouple, a flame rectification device, or any other suitable safety device.

The flame in the burners 162 may be counter-flow to the direction of combustion gas flow in the system, resulting in substantially all of the air/fuel mixture passing through the perforations in the burner assembly 160 to the flame. The combustion of the air/fuel mixture occurs substantially inside burners 162 along the inner perforated surfaces of burners 162. Combustion within burners 162 allows substantially all of the heat of combustion to be focused at open ends 164*b* of burners 162.

In the manner described, the air and fuel are mixed upstream of burners 162 in mixing tube 110, and then flowed into burners 162 for combustion. Accordingly the air and fuel are "premixed" prior to delivery to burners 162, in contrast to injection of the fuel at the burner, where the fuel mixes with air. Accordingly, as used herein, the terms "premix" and "premixed" are used to refer to burners and furnaces in which the air and fuel are mixed upstream of the burners.

Referring still to FIGS. 1-3, each heat exchanger 180 is a bent, S-shaped tubular that extends through a tortuous path to enhance the surface area available for heat transfer with the surrounding circulation air. Each heat exchanger 180 has a first open end 180*a* defining a flue gas inlet and a second open end 180*b* defining a flue gas outlet. First end 180*a* of each heat exchanger 180 is attached to post combustion chamber 170 and is axially opposed open end 164*b* of a corresponding burner 162. Second end 180*b* of each heat exchanger 180 is attached to exhaust chamber 190. Thus, heat exchangers 180 transport hot flue gases from post combustion chamber 170 to exhaust chamber 190. Although heat exchangers 180 are tubular in this embodiment, in general, the heat exchangers (e.g., heat exchangers 180) may be, for example, clamshell, drum or shell and tube type heat exchangers.

Substantially enclosing burners 162 within heat exchanger supply tubes 140 and substantially containing combustion within burners 162 offers the potential to reduce the amount of thermal radiation emitted to parts of furnace 100 other than the heat exchangers 180. Open ends 164*b* of burners 162 are in fluid communication with post combustion chamber 170, which is attached to inlet 181 of each heat exchanger 180 to ensure that substantially all of the heat generated by the burners 162 is transferred directly into heat exchangers 180 by directing hot flue gases through inlets 181 into heat exchangers 180. Post combustion chamber 170 seals the system from secondary dilution air as well as positions heat exchangers 180 for transfer of the hot flue gasses from burners 162.

In general, combustion air may be introduced into furnace 100 either in induced draft mode, by pulling air through the system, or in forced draft mode by pushing air through the system. In this embodiment, induced draft mode is employed by pulling the hot flue gases from exhaust chamber 190 with a blower or fan 195 by creating a relatively lower pressure at the exhaust of heat exchanger exhaust chamber 190. Alternatively, forced draft mode may be accomplished by placing a blower or fan between the air/fuel mixing tube (e.g., mixing tube 110) and the manifold inlet (e.g., manifold inlet connection flange 122) and forcing air into the system through the manifold (e.g., manifold 120). A control system may control the fan or blower (e.g., blower 195) to an appropriate speed to achieve adequate air flow for a desired firing rate through the burners (e.g., burners 162). Increasing the fan speed of the combustion blower will introduce more air to the air/fuel mixture, thereby changing the characteristics of the combustion within the burners.

Referring again to FIG. 1, a circulation blower (not shown) blows circulation air across heat exchangers 180 to enable the transfer of thermal energy from heat exchangers 180 to the air. The heated, exiting airflow is then distributed to an area that is to be conditioned.

As previously described and shown in FIGS. 2 and 3, mixing tube 110 is coupled end-to-end with intake manifold 120, burner assembly 160 is coupled to intake manifold 120 and post combustion chamber 170. In particular, connection flanges 113, 122 are bolted together, and flanges 123, 161 are bolted together. To reduce and/or eliminate the undesirable leakage of external air into intake manifold 120 and burners 162, a gasket is preferably disposed between mating flanges 113, 122 and mating flanges 123, 161.

Figure 11:
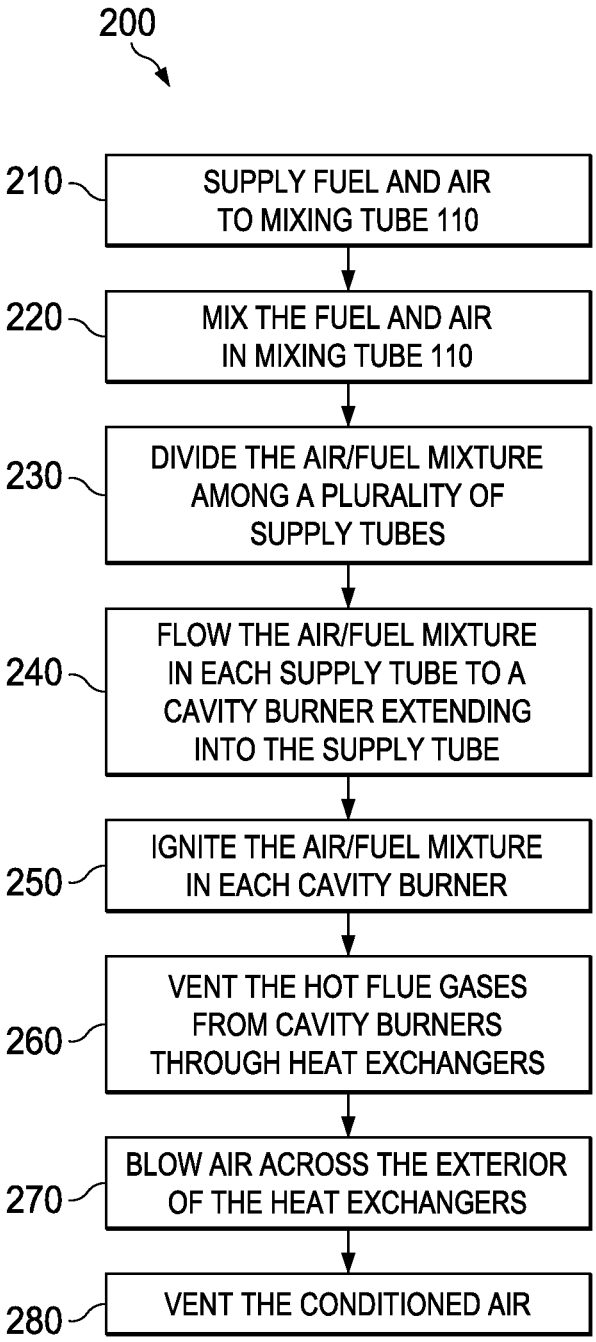
FIG. 11 is a schematic flow chart illustrating an embodiment of a method of conditioning air with the gas-fired furnace of FIG. 1.

Referring now to FIG. 11, a block diagram depicting a method 200 for conditioning (e.g., heating) air with furnace 100 is schematically shown. Method 200 begins at block 210 by supplying air and fuel to mixing tube 110. As previously described, the fuel is provided to mixing tube 110 by gas supply valve 105. The fuel may be natural gas or propane. In this embodiment, the air is pulled from the surrounding environment into inlet 111 of mixing tube 110 via induced draft powered by blower 195. Within mixing tube 110, the air and fuel are mixed together according to block 220. To enable substantially even distribution of air and fuel among supply tubes 140 and to enhance efficiency of furnace 100, the air and fuel are preferably homogenously mixed. An additional air/fuel mixing device may be included in mixing tube to actively mix the air and fuel therewithin.

In this embodiment, intake manifold 120 of furnace 100 is monolithically formed as a single piece, thereby eliminating several discrete couplings that are common along the air/fuel intake assembly of most conventional gas-fired furnaces. In particular, many conventional gas-fired furnaces include a mixing box that is coupled to the upstream end of each of a plurality of discrete heat exchanger inlet tubes. The mixing box functions to distribute the air/fuel mixture among the heat exchanger inlet tubes. In addition, many conventional gas-fired furnaces include a separate and distinct burner box that is coupled to the downstream end of each heat exchanger inlet tube and positioned between the heat exchanger inlet tubes and the burner assembly. Accordingly, each heat exchanger inlet tube is independently coupled to the mixing box and the burner box. Although gaskets are typically employed in each of the connections with the heat exchanger inlet tubes, these connections are susceptible to leaks and frequently allow external air to access the intake assembly, thereby altering the air-fuel ratio and potentially increasing NOx emissions. However, in furnace 100, many of these connections have been eliminated. Specifically, heat exchanger supply tubes 140 are monolithically formed with distributor 130 and outlet connection flange 123, thereby eliminating the mechanical couplings with each supply tube inlet 141 and each supply tube outlet 142. As a result, embodiments of furnace 100 and intake manifold 120 offer the potential to reduce ingress of external air into the air/fuel mixture and NOx emissions.

Method 200 continues at block 230 where the air/fuel mixture flows into intake manifold 120 and is evenly divided among heat exchanger supply tubes 140 by distributor 130. Moving now to block 240, the air/fuel mixture in each supply tube 140 flows to a burner 162 disposed within that particular supply tube 140. At each burner 162, the air/fuel mixture flows through holes in end 164*a* and tubular 164 to the interior of the burner 162. Within burners 162, the air/fuel mixture is ignited with igniter 175 according to block 250. Combustion may occur at least partially within the interior burners 162 so that generated heat is forced out of open ends 164*b* and into post combustion chamber 170 and heat exchangers 180. It should be appreciated that combustion may occur just outside burner cavities 162, for example, slightly downstream of open ends 164*b*. Open ends 164*b* of each burner 162 face post combustion chamber 170 and a corresponding inlet of one heat exchanger 180 attached to combustion chamber 170. Thus, hot flue gases resulting from combustion of the air/fuel mixture in each burner cavities 162 pass through chamber 170 and vent into heat exchangers 180 in block 260.

Moving now to block 270, as the hot flue gases travel through heat exchangers 180 in route to heat exchanger exhaust chamber 190, thermal energy is transferred from the flue gas to the heat exchangers 180. Air that is exterior to heat exchangers 180 is moved across the outer surface of heat exchangers 180 with a circulation blower. As the air moves across heat exchangers 180, thermal energy is transferred from heat exchangers 180 to the air, thereby heating the air. Method 200 concludes at block 280 by venting the heated air into an air conditioned space, for example, an office space or living area of a home. The heated air may be used to warm the space in order to increase comfort levels for occupants or to maintain the contents of the space at a pre-determined temperature.

Figure 12:
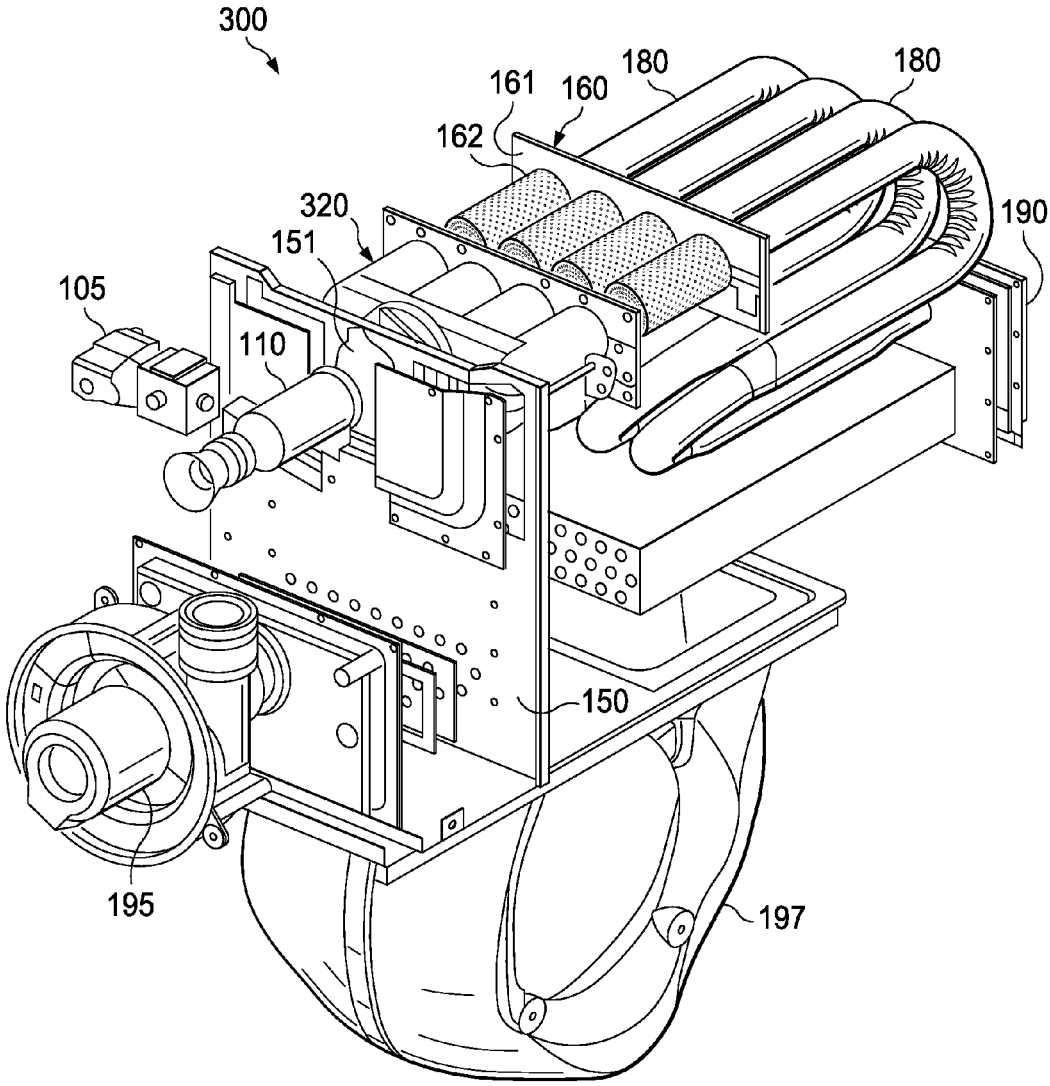
FIG. 12 is a perspective exploded view of a gas-fired furnace according to the principles described herein.
Figure 13:
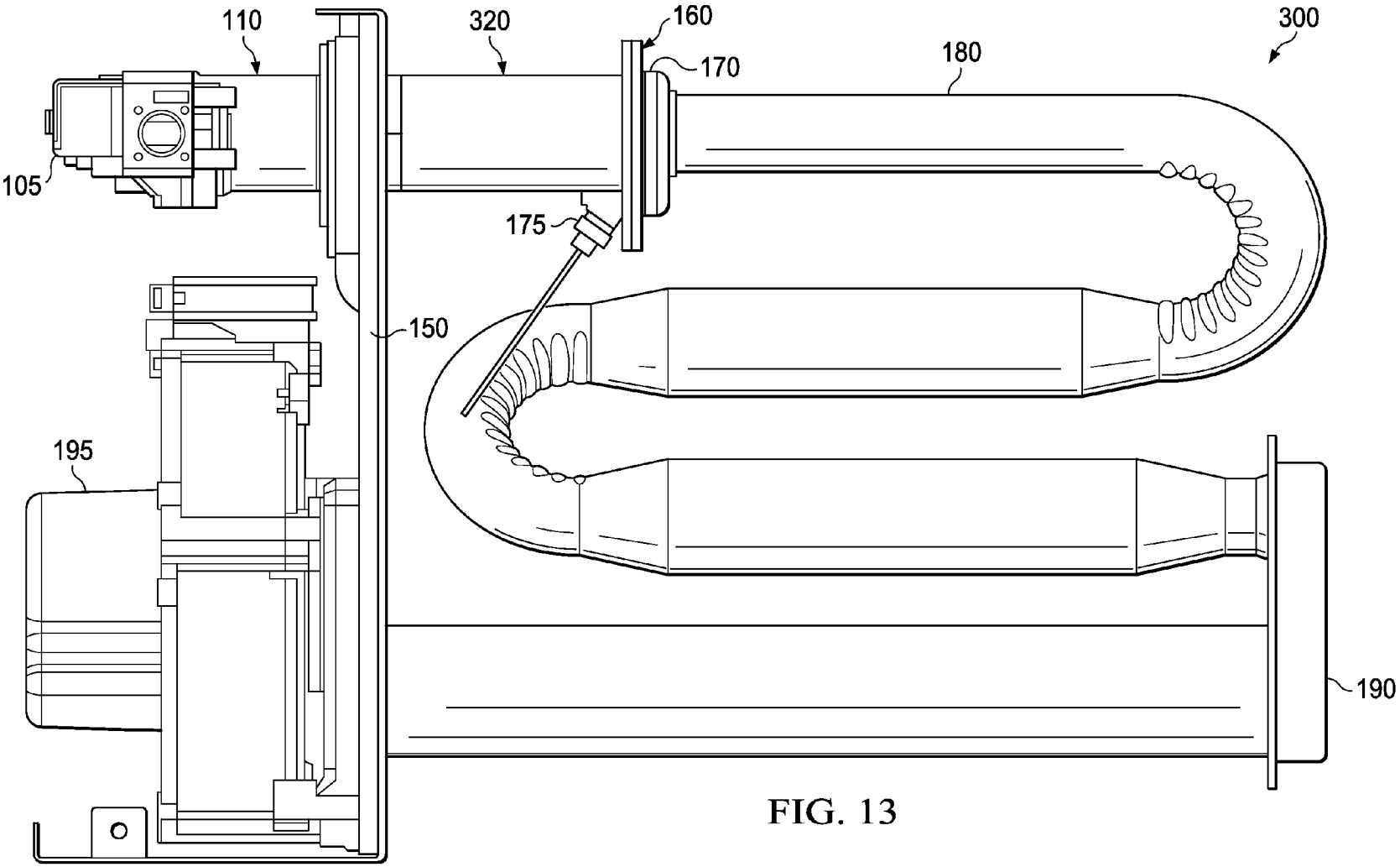
FIG. 13 is a side view of the gas-fired furnace of FIG. 12.
Figure 14:
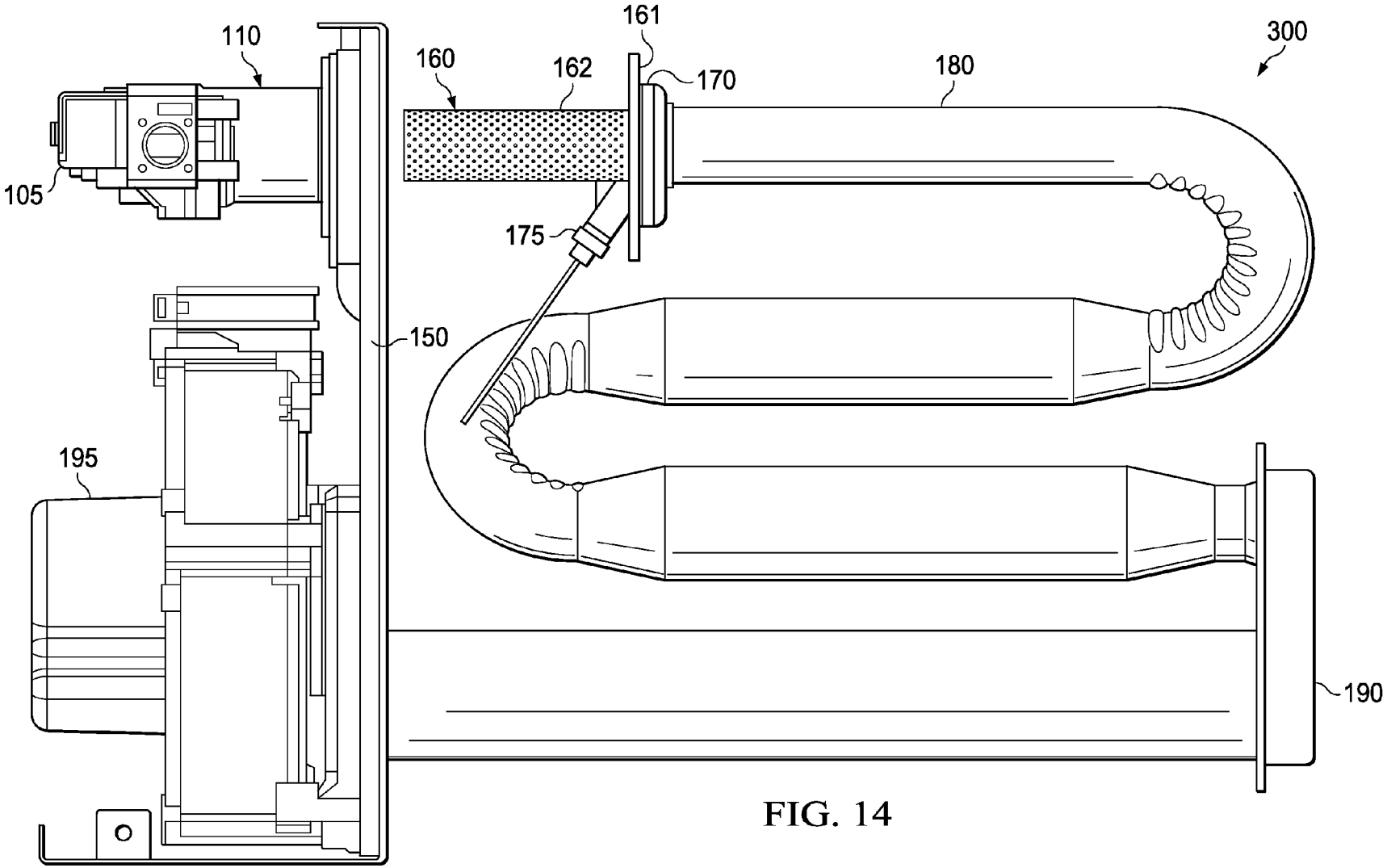
FIG. 14 is a side view of the gas-fired furnace of FIG. 12 with the intake manifold removed.
Figure 15:
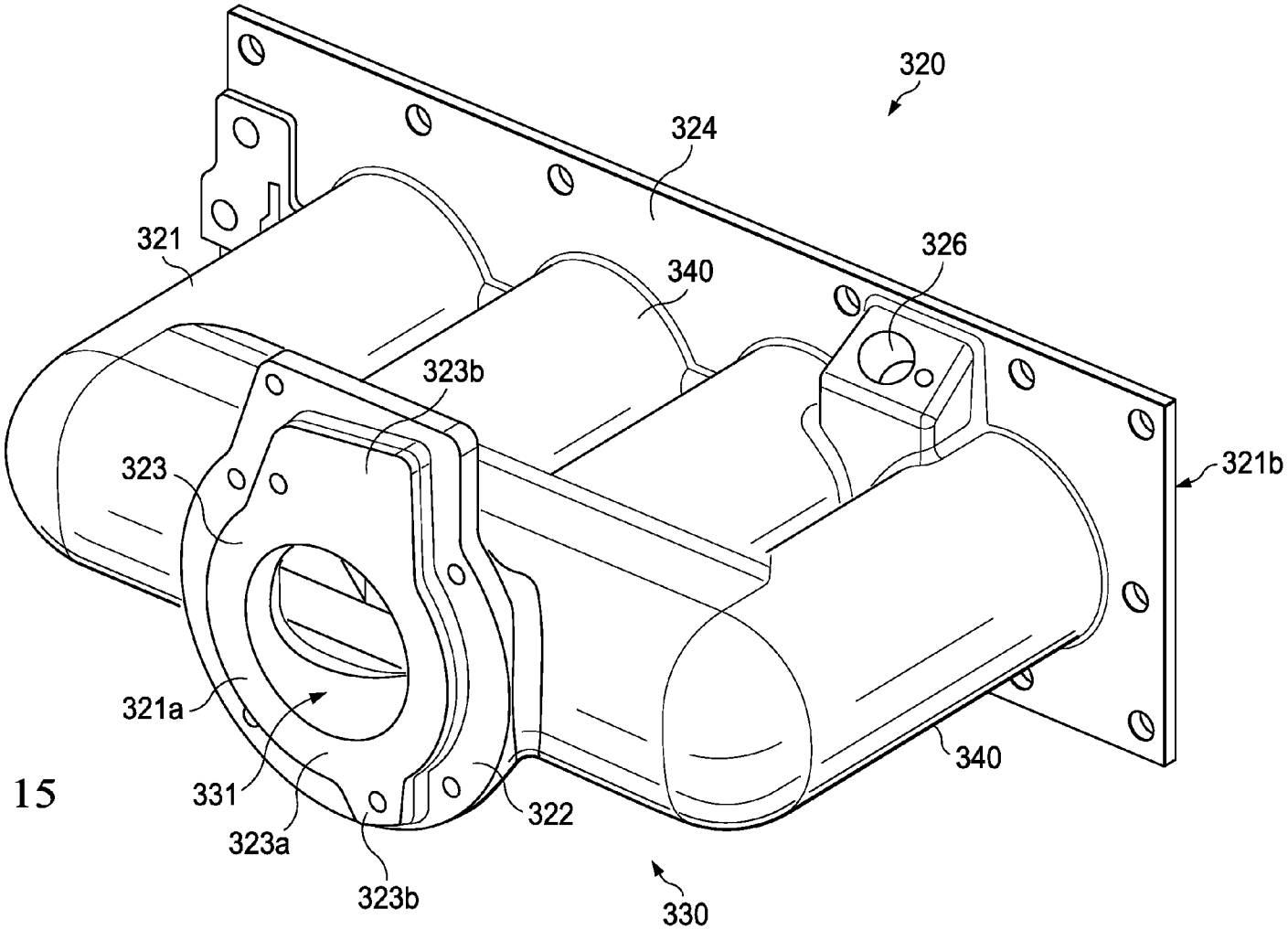
FIG. 15 is a perspective view of the intake manifold of FIG. 12.

Referring now to FIGS. 12-14, another embodiment of a gas-fired furnace 300 in accordance with the principles described herein is shown. In general, furnace 300 may be an indoor or outdoor furnace that provides conditioned air (i.e., heated air) to an interior space. Gas-fired furnace 300 is substantially the same as furnace 100 previously described. Namely, furnace 300 includes a gas supply valve 105, an air/fuel mixing tube 110, a partition panel 150, a burner assembly 160, a post combustion chamber 170, a plurality of heat exchangers 180, and a heat exchanger exhaust chamber 190, each as previously described. A blower 195 pulls the hot flue gases from exhaust chamber 190, thereby inducing fluid flow through furnace 300, and a circulation blower 197 moves air over the exterior of heat exchangers 180. Blowers 195, 197 are each as previously described. Similar to furnace 100, in this embodiment, furnace 300 includes an intake manifold 320 extending between mixing tube 110 and burner assembly 160. However, in this embodiment, intake manifold 320 is configured differently than intake manifold 120 previously described. Other than the differences in intake manifold 320 as compared to intake manifold 120, furnace 300 operates in the same manner as furnace 100 previously described. Although a finned condensing heat exchanger is shown extending from exhaust chamber 190 below heat exchangers 180, in general, furnace 300 may be operated with or without a condensing heat exchanger as a "condensing" or "non-condensing" furnace, respectively.

Figure 16:
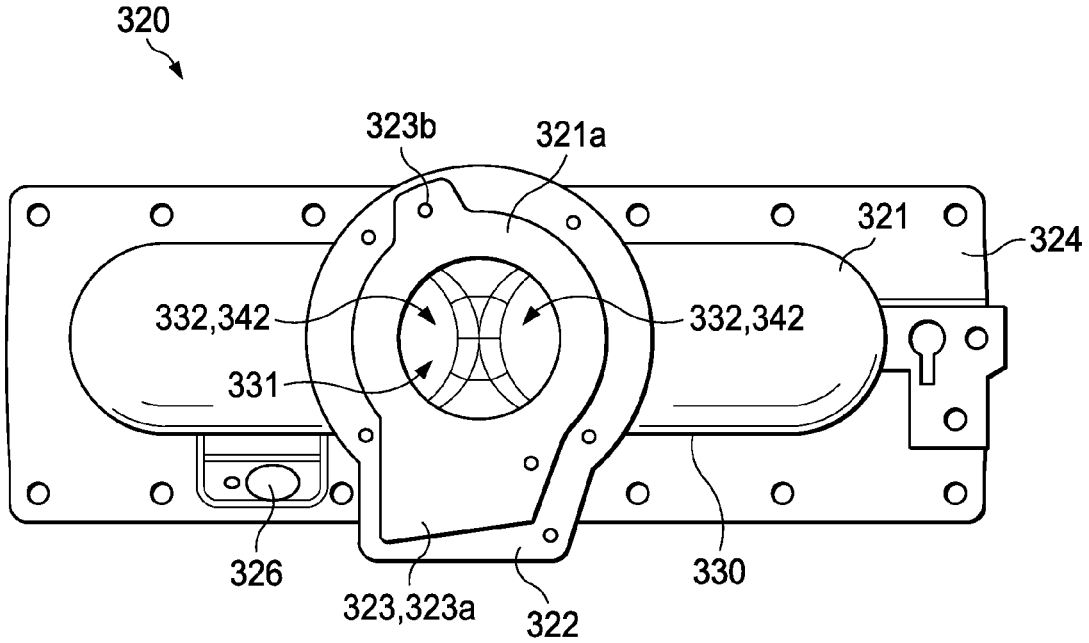
FIG. 16 is an inlet end view of the intake manifold of FIG. 12.
Figure 17:
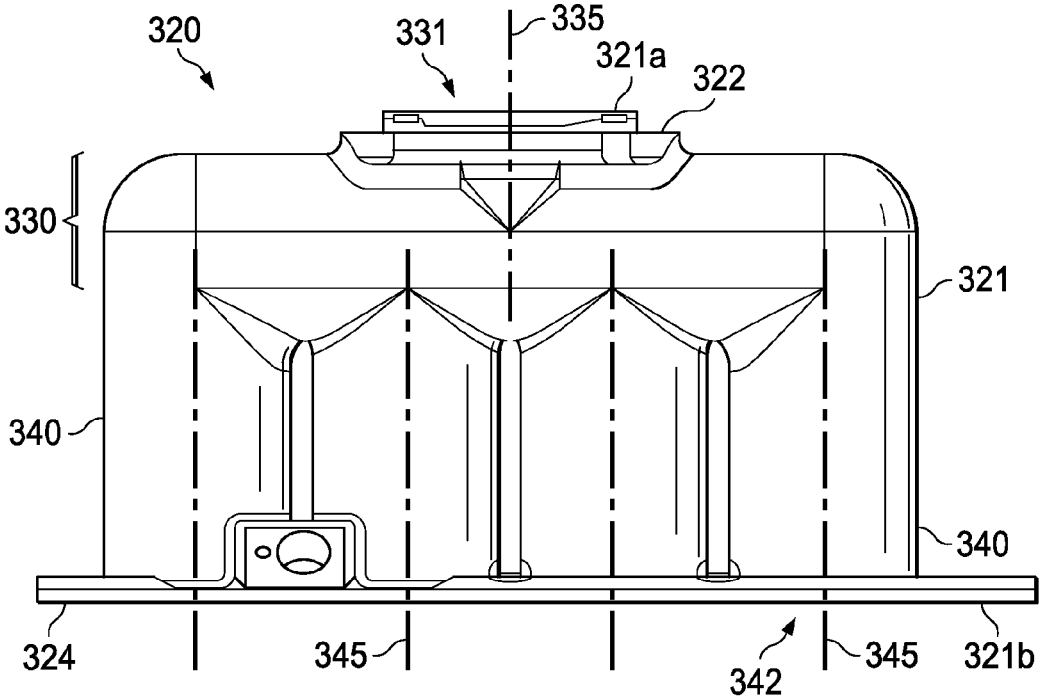
FIG. 17 is a top view of the intake manifold of FIG. 12.
Figure 18:
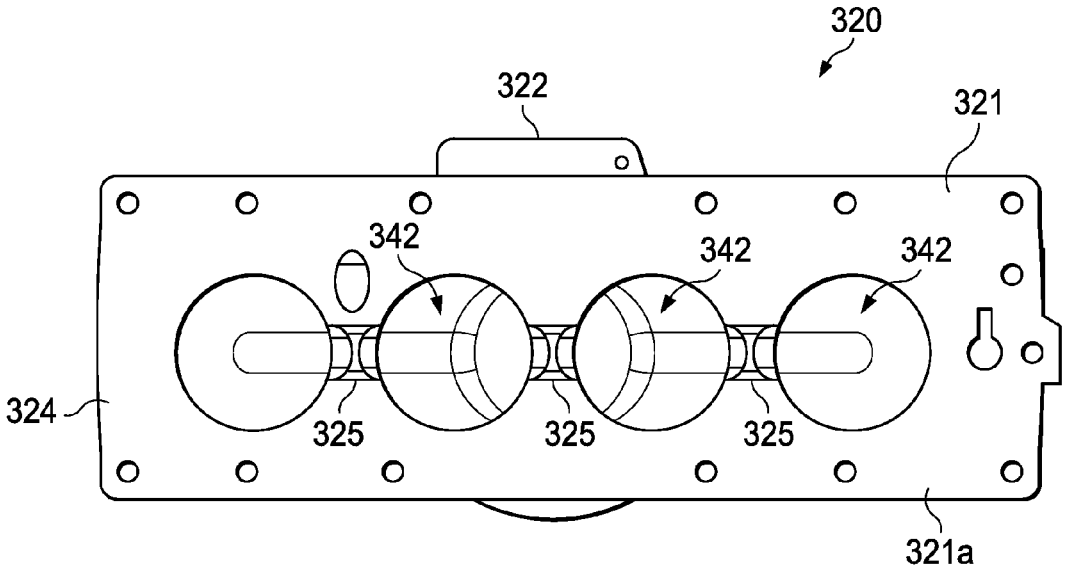
FIG. 18 is an outlet end view of the intake manifold of FIG. 12.

Referring now to FIGS. 15-18, in this embodiment, intake manifold 320 comprises a single-piece or monolithic body 321 having an upstream or inlet end 321*a*, a downstream or outlet end 321*b*, a flow distribution section 330 extending from inlet end 321*a*, and a plurality of heat exchanger supply tubes 340 extending from distribution section 330 to outlet end 321*b*. In addition, body 321 includes a connection flange 322 adjacent end 321*a* for coupling manifold 320 to partition panel 150, a male coupling member 323 extending axially from flange 322 to end 321*a*, and a outlet connection flange 324 at end 321*a* for coupling manifold 320 to burner assembly 160 and post combustion chamber 170. In this embodiment, flange 322 abuts panel 150 and is bolted to panel 150, thereby coupling intake manifold 320 to panel 150; and member 323 extends into a mating hole 151 in panel 150. Member 323 has a planar face 323*a* defining end 321*a* that is bolted to mating flange 113 of mixing tube 110. As best shown in FIG. 16, member 323 does not have circular profile, but rather, includes radial extensions 323*b* that positively engage mating recesses in panel hole 151, thereby restricting and/or preventing intake manifold 320 from rotating relative to panel 150 and ensure proper alignment of intake manifold 320 and panel 150. As best shown in FIG. 18, outlet connection flange 324 includes a recess 325 extending between each pair of adjacent heat exchanger supply tubes 340 at end 321*b*.

The air/fuel mixture flow through an air/fuel inlet 331 in distributor section 330 at end 321*a* and is distributed among the plurality of heat exchange supply tubes 340 via air/fuel outlets 332 of distributor section 330—one outlet 332 is provided for each heat exchanger supply tube 340. As with distributor 120 previously described, in this embodiment, distributor 330 is configured to evenly distribute the air/fuel mixture among the heat exchanger supply tubes 340.

Referring still to FIGS. 15-18, each supply tube 340 is a tubular having an inlet 341 in fluid communication with one outlet 332, and an outlet 342 at end 321*b*. As best shown in FIG. 16, the transition between each outlet 332 and corresponding supply tube inlet 341 on the inner surface of body 321 is radiused to streamline flow of the air/fuel mixture from distributor section 330 into supply tubes 340, and to enhance uniform distribution of the air/fuel mixture among the plurality of supply tubes 340.

Referring briefly to FIGS. 13 and 17, intake manifold 320, distributor section 330, and inlet 331 share a common central axis 335, and each heat exchanger supply tube 340 and associated outlet 332 has a central axis 345 that is parallel to axis 335. In this embodiment, each axis 335, 345 is disposed in the same plane, and further, as oriented in furnace 300, the plane containing each axis 335, 345 is horizontal.

In general, intake manifold 320 may comprise any suitable material(s), but preferably comprises durable materials suitable for high temperature furnace applications. In addition, as previously described, body 321 of intake manifold 320 is monolithically formed. Thus, intake manifold 320 preferably comprises a material that may be cast, machined, or otherwise formed as a single-piece such as steel or aluminum.

Referring now to FIGS. 12-14, flange 161 of burner assembly 160 is sandwiched between connection flange 324 of intake manifold 320 and post combustion chamber 170. Recess 163 in flange 161 is opposed recess 325 of intake manifold 320, and together, define a flame carry over path. Burners 162 extend axially through outlets 342 into supply tubes 340—one burner 162 is coaxially disposed within each supply tube 340. Each supply tube 340 is sized to have an inner diameter slightly larger than the outer diameter of its corresponding burner 162.

Referring again to FIGS. 12-14 and 16, an igniter 175 as previously described is mounted to flange 324 of intake manifold 320 has an ignition tip positioned in the flame carryover path defined by recesses 163, 325 to ignite the air/fuel mixture therein. In particular, igniter 175 is received in an igniter receptacle 326 extending through flange 324. The ignition flame travels through the flame carryover path to each burner 162, thereby enabling ignition of the air/fuel mixture in each burner 162. In addition, a flame sensor 176 is mounted to flange 324 of intake manifold 320 on the opposite side of intake manifold 320 from igniter 175. Flame sensor 176 detects when the flame front extends across each of burners 162. Flame sensor 176 may comprise a thermocouple, a flame rectification device, or any other suitable safety device.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, RI, and an upper limit, Ru, is disclosed, any number falling within the range is specifically disclosed. In particular, the following numbers within the range are specifically disclosed: $R=RI+k*(Ru-RI)$, wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. A gas-fired air conditioning furnace, comprising:

a monolithic intake manifold including an inlet at a first end and a plurality of outlets at a second end opposite the first end;

a burner assembly including a plurality of burners, each burner configured to combust an air-fuel mixture at least partially within an interior space of the burner; and wherein each burner extends into one of the outlets of the intake manifold.

2. The furnace of claim 1, wherein the intake manifold includes a distributor extending from the first end and a plurality of supply tubes extending from the second end to the distributor;

wherein the distributor includes the inlet and each supply tube includes one of the plurality of outlets;

wherein the distributor is configured to divide the air-fuel mixture among the plurality of supply tubes.

3. The furnace of claim 2, wherein the distributor includes a plurality of outlets, wherein each of the plurality of outlets of the distributor is configured to supply a portion of the air-fuel mixture to one of the supply tubes.

4. The furnace of claim 2, wherein the inlet of the intake manifold has a central axis and each of the supply tubes has a central axis that is parallel to the central axis of the inlet.

5. The furnace of claim 4, wherein the central axis of the inlet and the central axis of each supply tube is disposed in a common plane.

6. The furnace of claim 2, wherein each burner comprises a cylindrical body having an occluded end disposed in the intake manifold and an open end extending from one of the outlets of the intake manifold.

7. The furnace of claim 6, wherein the cylindrical body and the occluded end of each burner includes a plurality of perforations that allow the air-fuel mixture to pass through the cylindrical body and the occluded end into the interior space of the burner.

8. The furnace of claim 2, further comprising:

a post combustion chamber and a plurality of heat exchangers extending from the post combustion chamber, wherein the burner assembly is positioned between the intake manifold and the post combustion chamber, and wherein the heat exchangers are configured to receive hot flue gases from the burners;

a mixing tube coupled to the first end of the intake manifold and a gas supply valve coupled to the mixing tube, wherein the mixing tube is adapted to mix air and a fuel supplied by the gas supply valve to form the air-fuel mixture.

9. The furnace of claim 1, wherein the intake manifold includes a flange positioned between the first end and the second end, wherein the flange couples the intake manifold to a partition panel.

10. An intake manifold for a gas-fired device, comprising:

a monolithic body having a first end and a second end opposite the first end;

an inlet at the first end of the body, the inlet comprising a first axis;

a plurality of outlets at the second end of the body; and a mounting flange (1) disposed between the first end of the body and the second end of the body and (2) axially offset along the first axis from each of the first end of the body and the second end of the body;

wherein the body includes:

a distributor section including the inlet and a plurality of supply tubes extending from the distributor section, wherein each supply tube includes one of the plurality of outlets;

wherein the distributor is configured to receive an air-fuel mixture through the inlet and divide the air-fuel mixture among the plurality of supply tubes.

11. The intake manifold of claim 10, wherein the distributor section includes a plurality of outlets configured to supply a portion of the air-fuel mixture to the supply tubes.

12. The intake manifold of claim 11, wherein each supply tube includes a flow path extending from one of the outlets of the distributor section to one of the outlets of the body.

13. The intake manifold of claim 12, wherein the flow path of each supply tube has a central axis that is parallel to the first axis of the inlet.

14. The intake manifold of claim 13, wherein the first axis of the inlet and the central axis of each flow path lies in a common plane.

15. A method of operating a gas-fired furnace, comprising:

(a) supplying an air-fuel mixture to a single-piece intake manifold, wherein the intake manifold has an inlet at a first end and a plurality of outlets at a second end opposite the first end, and wherein the intake manifold includes a distributor extending from the first end and a plurality of supply tubes extending from the second end to the distributor;

(b) flowing the air-fuel mixture through the inlet of the intake manifold into the distributor;

(c) dividing the air-fuel mixture in the distributor into a plurality of portions;

(d) flowing each portion of the air-fuel mixture through one of the supply tubes to a burner extending into the supply tube, wherein one burner extends into each supply tube;

(e) combusting the portion of the air-fuel mixture within each burner to form a hot flue gas.

16. The method of claim 15, further comprising (f) flowing the hot flue gas through each outlet to a heat exchanger.

17. The method of claim 15, wherein (d) further comprises flowing each portion of the air fuel mixture through perforations in the corresponding burner.

18. The method of claim 16, further comprising (g) flowing air across an exterior surface of each heat exchanger.

19. The method of claim 18, further comprising:

mixing a gaseous fuel and air in a mixing tube to form the air-fuel mixture supplied to the intake manifold.

* * * * *